US011469066B2

(12) United States Patent
Hofsaess

(10) Patent No.: US 11,469,066 B2
(45) **Date of Patent: *Oct. 11, 2022**

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/025,305

(22) Filed: Sep. 18, 2020

(65) Prior Publication Data

US 2021/0090834 A1 Mar. 25, 2021

(30) Foreign Application Priority Data

Sep. 20, 2019 (DE) ..... 10 2019 125 451.5

(51) Int. Cl.
*H01H 37/04* (2006.01)
*H01H 37/54* (2006.01)
*H01H 37/64* (2006.01)

(52) U.S. Cl.
CPC ..... *H01H 37/5409* (2013.01); *H01H 37/04* (2013.01); *H01H 37/64* (2013.01); *H01H 2037/549* (2013.01)

(58) Field of Classification Search
CPC .... H01H 37/5409; H01H 37/04; H01H 37/64; H01H 2037/549
(Continued)

(56) References Cited

U.S. PATENT DOCUMENTS 4,039,991 A * 8/1977 Bucheister ..... H01H 37/5409 337/348
4,053,859 A 10/1977 Hollweck
(Continued)

FOREIGN PATENT DOCUMENTS

DE 2432901 A1 1/1976
DE 2544201 A1 4/1977
(Continued)

OTHER PUBLICATIONS

Search Report issued by the European Patent Office for application EP20196350.1 dated Feb. 3, 2021; 5 pages.
(Continued)

*Primary Examiner* — Anatoly Vortman
(74) *Attorney, Agent, or Firm* — Reising Ethington, P.C.

(57) ABSTRACT

A temperature-dependent switch having a housing with an upper part and a lower part, wherein a first and a second stationary contact are arranged on the housing, and a temperature-dependent switching mechanism having a movable contact member. In its first switching position, the switching mechanism presses the movable contact member against the first contact and thereby produces an electrically conductive connection between the two contacts via the contact member, and, in its second switching position, keeps the movable contact member spaced apart from the first contact. A closing lock prevents the switch, once having opened, from closing again by locking the switching mechanism permanently in its second switching position in a mechanical manner. The closing lock comprises a substantially disc-shaped locking element and a first latching member, which, in order to lock the switching mechanism, interacts in the second switching position with a second latching member that is arranged on the movable contact member.

20 Claims, 6 Drawing Sheets

(58) Field of Classification Search
USPC ..... 337/89
See application file for complete search history.

(56) References Cited

U.S. PATENT DOCUMENTS 4,554,525 A 11/1985 Bayer
5,003,282 A * 3/1991 Boulanger ..... H01H 37/5409 337/348
5,703,560 A * 12/1997 Short ..... H01H 37/5409 337/333
5,861,794 A * 1/1999 Pellon ..... H01H 77/04 337/365
5,929,742 A * 7/1999 Short ..... H01H 37/5409 337/348
5,986,535 A * 11/1999 Stiekel ..... H01H 37/5427 337/298
6,590,489 B1 * 7/2003 Ullermann ..... H01H 9/32 337/56
6,741,159 B1 * 5/2004 Kuczynski ..... H01H 37/002 337/142
7,209,336 B2 * 4/2007 Yu ..... H01C 7/126 200/400
7,218,200 B2 * 5/2007 Hayashi ..... H01H 37/5409 337/348
9,666,394 B2 * 5/2017 Kamiyama ..... H01H 37/34
10,861,662 B2 * 12/2020 Hofsaess ..... H01H 37/74
2004/0100354 A1 * 5/2004 Davis ..... H01H 37/5409 337/356
2014/0225709 A1 8/2014 Kirch et al.
2019/0221390 A1 7/2019 Hofsaess

FOREIGN PATENT DOCUMENTS

DE 2732439 A1 1/1978
DE 8625999 U1 11/1986
DE 4321960 A1 1/1994
DE 102007042188 B3 4/2009
DE 102013101392 A1 8/2014
DE 102018100890 B3 7/2019
EP 3511968 A1 * 7/2019 ..... H01H 37/70
GB 2240218 A 7/1991
GB 2269480 A 2/1994

OTHER PUBLICATIONS

Office action issued by the German Patent Office for application DE 2019 125 451.5 dated Sep. 11, 2020; 7 pages.

* cited by examiner

TEMPERATURE-DEPENDENT SWITCH

CROSS REFERENCE TO RELATED APPLICATIONS

This application claims priority from German patent application DE 10 2019 125 451.5, filed on Sep. 20, 2019. The entire contents of this priority application are incorporated herein by reference.

BACKGROUND

This disclosure relates to a temperature-dependent switch.

An exemplary temperature-dependent switch is disclosed in DE 10 2018 100 890 B3.

Such temperature-dependent switches are usually used for the purpose of protecting electrical devices from overheating. To this end, the switch is connected in series to the device to be protected and to the supply voltage thereof and is arranged mechanically on the device such that it is thermally connected to the device.

A temperature-dependent switching mechanism ensures that the two stationary contacts of the switch are electrically connected to each other below the response temperature of the switching mechanism. Hence, the circuit is closed below the response temperature and the load current of the device to be protected can flow through the switch.

If the temperature rises above an admissible value, the switching mechanism lifts off the movable contact member from the counter contact, opening the switch and disconnecting the load current of the device to be protected. The now current-less device can then cool down again. In this case, the switch, which is coupled thermally to the device, also cools down and would thereupon actually close again automatically.

However, in the case of the switch disclosed in DE 10 2018 100 890 B3, a closing lock ensures that this switching back does not occur in the cooled-down position, so that the device to be protected, once being switched off, cannot switch itself on again automatically. The closing lock mechanically locks the switching mechanism, so that the switching mechanism, once been opened, cannot close again, even if strong vibrations or temperature fluctuations occur.

This is a safety function that applies, for example, to electric motors that are used as drive units. This is intended in particular to prevent damage to the device or even injury to the person using the device.

Due to their switching behavior, such switches, which do not close again after being opened once, are also called one-time switches.

A further switch of this type is disclosed in DE 10 2013 101 392 A1. This switch comprises a temperature-dependent switching mechanism having a temperature-dependent bimetal snap-action disc and a bistable spring disc which carries a movable contact or a current transfer member. When the bimetal snap-action disc is heated to a temperature above its response temperature, it lifts off the contact or the current transfer member from the counter contact or counter contacts against the force of the spring disc and thereby presses the spring disc into its second stable configuration in which the switching mechanism is situated in its high-temperature position.

When the switch and thus the bimetal snap-action disc cool down again, the bimetal snap-action disc returns to its low-temperature position. However, due its design, its edge cannot rest on a counter bearing, such that the spring disc remains in the stable second configuration in which the switch is open.

This means that the switch remains in its open position after opening once, even if it cools down again. However, tests carried out by the company of the applicant have shown that the switch disclosed in DE 10 2013 101 392 A1 does close again in the event of stronger mechanical vibrations such that—under safety aspects—it may not be the perfect solution in some applications.

It is also known to provide such temperature-dependent switches with a so-called self-holding resistor which is connected in parallel with the two counter contacts so that it takes over part of the load current when the switch opens. Ohmic heat, which is sufficient to hold the snap-action disc above its response temperature, is generated in the self-holding resistor.

However, this so-called self-holding is only active for as long as the electric device is still switched on. As soon as the device is shut off from the supply circuit, no more current flows through the temperature-dependent switch either so that the self-holding function is cancelled. After the electric device has been switched on again, the switch would therefore be situated in the closed state again so that the device is able to heat up again, which could result in consequential damage.

This problem is avoided with the switches disclosed in DE 10 2007 042 188 B3 and DE 10 2013 101 392 A1, where the self-holding function is not realized electrically, but by means of a bistable spring part, which has two stable geometric configurations in a temperature-independent manner, as is described in the above-cited documents.

In contrast to this, the snap-action disc is a bistable snap-action disc that assumes either a high-temperature configuration or a low-temperature configuration in a temperature-dependent manner.

In the DE 10 2007 042 188 B3 mentioned at the outset, the spring disc is a circular snap-action spring disc on the middle of which the contact member is fastened. The contact member is, for example, a movable contact part which is pressed by the snap-action spring disc against the first stationary contact which is arranged on the inside of a cover of the housing of the switch. The snap-action spring disc presses by way of its edge against an inner bottom of a lower part of the housing which acts as a second contact. In this way, the snap-action spring disc, which is itself electrically conducting, produces an electrically conducting connection between the two counter contacts.

In its low-temperature position, the bimetal snap-action disc lies loosely against the contact part. If the temperature of the bimetal snap-action disc increases, it switches to its high-temperature position, in which it presses with its edge against the inside of the upper part of the housing and, concurrently with its center onto the snap-action spring disc such that the snap-action spring disc switches from its first to its second stable configuration, as a result of which the movable contact part is lifted off from the stationary contact and the switch is opened.

If the temperature of the switch cools down again, the bimetal snap-action disc switches back to its low-temperature position again. In this case, it moves with its edge into abutment with the edge of the snap-action spring disc and with its center into abutment with the upper part of the housing. However, the actuating force of the bimetal snap-action disc is not sufficient to let the snap-action spring disc switch back into its first configuration again.

The bimetal snap-action disc only bends further once the switch has cooled down a lot such that it is finally able to press the edge of the snap-action spring disc onto the inner bottom of the lower part by such a distance that the snap-action spring disc switches into its first configuration again and closes the switch again.

The switch disclosed in DE 10 2007 042 188 B3 therefore, after being opened once, remains open until it has cooled down to a temperature below room temperature, for which purpose a cooling spray can be used, for example.

Although the switch meets the corresponding safety requirements in many applications, it has nevertheless been shown that as a result of bracing the bi-metal snap-action disc between the upper part of the housing and the edge of the snap-action spring disc, in rare cases the snap-action spring disc nevertheless springs back in an unwanted manner.

DE 10 2013 101 392 A1 furthermore proposes using a current transfer member as a movable contact member, for example in the form of a contact plate supported by the snap-action spring disc. Both stationary contacts are now arranged on the inner surface of the cover of the housing, wherein an electrically conductive connection between these two contacts is produced by placing the contact plate against these two contacts.

In the case of the switch, the snap-action spring disc is fixed with its edge on the lower part of the housing, while the bimetal snap-action disc is provided between the snap-action spring disc and the inner bottom of the lower part.

Below the response temperature of the bimetal snap-action disc, the snap-action spring disc presses the contact plate against the two stationary contacts. If the bimetal snap-action disc switches to its high-temperature position, it presses with its edge against the snap-action spring disc and pulls with its center the snap-action spring disc away from the upper part, so that the contact plate moves out of abutment with the two counter contacts. In order to make this geometrically possible, the contact plate, the snap-action spring disc and the bimetal snap-action disc are captively connected to each other by a centrally extending rivet.

When the temperature of the bimetal snap-action disc drops again, it switches back into its low-temperature position, but the spring disc remains in its assumed configuration as the bimetal snap-action disc lacks a counter bearing for its edge so that it is not able to press the current transfer member against the two stationary contacts again.

The switch therefore comprises a self-holding function due to the design. In rare cases, in the event of strong mechanical vibrations, the snap-action spring disc can spring back unintentionally here too.

Further, DE 25 44 201 A1 discloses a temperature-dependent switch having a current transfer member realized as a contact bridge, where the contact bridge is pressed against two stationary counter contacts via a closing spring. The contact bridge is in contact via an actuating bolt with a temperature-dependent switching mechanism which consists of a bimetal snap-action disc and a spring disc, both of which are clamped at their edges.

As with the switch disclosed in DE 10 2007 042 188 B3, the spring disc and the bimetal snap-action disc are both bistable, the bimetal snap-action disc in a temperature-dependent manner and the spring disc in a temperature-independent manner.

If the temperature of the bimetal snap-action disc increases, it presses the spring disc into its second configuration, in which it presses the actuating bolt against the contact bridge, lifting it off the stationary counter contacts against the force of the closing spring.

Even when the bimetal snap-action disc cools down, the spring disc remains in the second configuration and keeps the switch open against the force of the closing spring.

Pressure can then be exerted onto the contact bridge from outside by means of a button such that, as a result, the spring disc is pressed back into its first stable configuration by means of the actuating bolt.

Along with the very complex design, the switch, on the one hand, comprises the disadvantage that in the open state, the spring disc lifts the contact bridge from the counter contacts against the force of the closing spring so that the spring disc, in its second configuration, has to overcome the force of the closing spring in a reliable manner. Because the closing spring, however, in the closed state ensures the secure abutment of the contact bridge against the counter contacts, a spring disc with a very high degree of stability is required here in the second configuration.

A further switch with three switching positions is disclosed in DE 86 25 999 U1. A flexible tongue, which is clamped-in at one end and carries a movable contact part at its free end, which contact part interacts with a fixed counter contact, is provided in this switch.

A calotte is formed on the flexible tongue, which calotte is pressed into its second configuration, in which it distances the movable contact part from the stationary counter contact, by means of a bimetal plate which is also attached to the flexible tongue.

In the case of the switch, the calotte has to hold the movable contact part at a distance from the fixed counter contact against the closing force of the flexible tongue which is clamped-in at one end so that the calotte has to apply a high actuating force in its second configuration.

The switch consequently comprises the above-discussed disadvantages, namely that high actuating forces have to be overcome, which leads to high production costs and to a non-secure state in the cooled-down position.

The switch disclosed in DE 10 2018 100 890 B3, which was mentioned at the outset, has the mechanically most stable closing lock compared to the other mentioned switches. Due to the mechanical locking of the switching mechanism, which is produced by the closing lock, an accidental switch back after the switch has been open once is almost impossible.

It has been shown, however, that the closing lock disclosed in DE 10 2018 100 890 B3 is relatively complex to manufacture, so that the manufacturing costs of the switch are comparatively high.

SUMMARY

It is an object to provide a switch that it is easier and thus cheaper to manufacture and yet still guarantees a safe disconnection of the electric circuit even in the cooled-down position of the switch and in the event of strong vibrations.

According to a first aspect, a temperature-dependent switch is provided that comprises:

- a housing having a lower part and an upper part;
- a first stationary contact that is arranged on the upper part of the housing;
- a second stationary contact that is arranged on the housing;
- a temperature-dependent switching mechanism that is arranged in the housing and comprises a movable contact member, wherein, in a first switching position, the switching mechanism presses the movable contact member against the first stationary contact and thereby produces an electrically conductive connection between the first stationary contact and the second stationary contact via the movable contact member, and wherein, in a second switching position, the switching mechanism keeps the movable contact member spaced apart from the first stationary contact and thereby disconnects the electrically conductive connection; and a closing lock that prevents the switch once having opened from closing again by locking the switching mechanism permanently in the second switching position in a mechanical manner, wherein the closing lock comprises a substantially disc- or plate-shaped locking element, which is arranged locally between the switching mechanism and an inner bottom surface of the lower part, the locking element being clamped in the lower part and/or connected to the lower part by means of a firmly bonded connection, and wherein the closing lock comprises a first latching member and a second latching member, the first latching member being arranged on the locking element and the second latching member being arranged on the movable contact member, wherein the first latching member and the second latching member interact with each other in the second switching position in order to lock the switching mechanism.

Because the closing lock permanently mechanically locks the switching mechanism in a similar manner as the switch disclosed in DE 10 2018 100 890 B3, it cannot close again after having opened once, even in the event of strong vibrations. Consequently, the locking of the temperature-dependent switching mechanism also mechanically locks the switch, which is used synonymously in the context of the present disclosure. The herein presented switch is thus permanently prevented from switching back.

The closing lock is realized by locking the first latching member, which is arranged on the locking element, with the second latching member, which is arranged on the movable contact member. The first and second latching members thus act as counterparts which guarantee that the switching mechanism is locked after opening. Thereto, both the first and the second latching member can comprise one latching element, two latching elements or a plurality of latching elements.

In contrast to the closing lock disclosed in DE 10 2018 100 890 B3, the locking element belonging to the closing lock of the herein presented switch is configured as a separate component that may be mounted relatively easily in the lower part of the switch. The lower part as well as the other components of the switch can thus be manufactured independently of the closing lock in a relatively easy and inexpensive way. The locking element can be inserted in the lower part of the switch in an also very simple and inexpensive way. It is either connected to the lower part by means of a firmly bonded connection or clamped in it. The production of the closing lock is thus maximally simple and inexpensive.

The locking element is preferably a substantially plate- or disc-shaped body. The locking element has preferably at least for the most part a shape of a cylinder, the radius of which is many times larger than its thickness. The term "substantially plate- or disc-shaped" is used here to mean that the locking element does not necessarily have to be exactly plate- or disc-shaped, since individual elements or sections of the locking element can deviate from the pure plate- or disc-shape. In the overall view, however, it is mostly plate- or disc-shaped, i.e. in any case wider than high or thick.

However, the first latching member (or the latching members) arranged on the locking element may deviate from the pure plate- or disc-shape. Likewise, it is not necessarily required that the locking element is a continuous plate or disc made of solid material, as one or more recesses or holes may be provided therein.

The locking element is arranged between the switching mechanism and the inner bottom surface of the lower part. It is thus located below the switching mechanism.

The two latching members (first and second latching member) act as a kind of anchor with a corresponding counter support. They hold the switching mechanism in the open state after its temperature-dependent opening and prevent a corresponding switch-back even after the switch has cooled down below the reset temperature of the switching mechanism.

According to a refinement, the first latching member or the second latching member comprises a resilient tongue, a spring claw or a spring hook, wherein the respective other one of the two latching members comprises a recess, a hole or a latching lug.

This ensures a mechanically stable locking between the two latching members. At least one of the two latching members is preferably spring loaded (e.g. as a resilient tongue, spring claw or spring hook), so that the corresponding latching member yields when opening the switch and engages with the other latching member without much effort. The switching mechanism, when opening, therefore only needs to overcome a small amount of force to activate the closing lock.

As there can be a plurality of latching elements on each of the two latching members, there can be a plurality of resilient tongues, a plurality of spring claws or a plurality of spring hooks arranged on one latching member and a plurality of recesses, a plurality of holes or a plurality of latching lugs arranged on the other latching member.

According to a further refinement, it is provided that the locking element is arranged clamped between a spacer element and the lower part or between two spacer elements.

This enables a particularly simple assembly of the locking element and thus also of the entire closing lock. During assembly, the locking element is only clamped in the lower part by one or more spacer elements and is thus fixed to the lower part of the switch by this or these spacer elements. The clamping connection between the locking element and the lower part furthermore has the advantage that the lower part can be manufactured very easily. It does not necessarily have to be manufactured as a turned part, but can also be manufactured as a punched part. This leads to a further cost reduction.

According to a further refinement, it is intended that the locking element is clamped between a spacer element and the lower part, and that a part of the switching mechanism rests, at least in the first switching position, with its edge on the spacer element.

In addition to the advantages already mentioned above of the simplified production of the lower part as a punched part and the simplified assembly of the locking element, the use of a spacer element for clamping the locking element has the advantage that this makes it relatively easy to adjust the height of the switching mechanism. Depending on the height of the selected spacer element, the position of the switching mechanism can be adjusted and thus, for example, the contact pressure in the closed state of the switch can be adjusted.

Furthermore, the use of a distance element, which is arranged between the switching mechanism and the locking element, has the advantage that an ohmic resistance can be introduced between the locking element and the switching mechanism in an easy way. The spacer element can, for example, be made of an electrically insulating material. This prevents current from flowing through the locking element when the switch is closed or during the opening process. In the end, this measure prolongs the service life of the locking element, as it is in any way guaranteed that the current flowing through the switch is directly fed into the lower part via the switching mechanism.

The spacer element used to clamp the locking element is preferably configured as a spacer ring. Such a spacer ring can easily be inserted into or clamped to the interior of the lower part that is usually cylindrically shaped.

According to another refinement, the locking element is welded or soldered to the lower part, in particular to the inner bottom surface of the lower part.

Although this an alternative that is, with regard to production, more complex than clamping the locking element, the locking element can be fixed to the lower part by welding or soldering, which is with regard to production also relatively easy. Thus, even according to this alternative, a simple assembly of the closing lock is guaranteed. According to both alternatives (clamping or firmly bonded connection) the locking element is permanently and captively fixed to the lower part.

In principle, it is also conceivable that the locking element is both connected to the lower part by a firmly bonded connection and clamped between it and a spacer element.

In a further refinement, it is provided that the movable contact member comprises a latching lug in the region of its lower end facing the inner bottom surface, which latching lug forms the second latching member.

In this case, a kind of anchor is preferably arranged at the lower end of the movable contact member, in which anchor a latching lug is circumferentially formed. In the open state of the switch, i.e. in the second switching position of the switching mechanism, this latching lug forming the second latching member engages with the first latching member arranged on the locking element. In this case, the first latching member may, for example, comprise one or more spring claws which, in the second position of the switching mechanism, engage with the latching lug arranged on the anchor and thus permanently keep the switching mechanism in the second position.

Preferably, the contact member is frustoconical, round or tapered between its lower end and the latching lug.

This makes it easier to lock the first latching member, which is arranged on the locking element, with the latching lug. When opening the switch, the switching mechanism only has to overcome a slight pressure so that the latching lug, which is arranged on the lower side of the movable contact member, snaps into the first latching member.

According to a further refinement, it is provided that the locking element comprises a substantially annular section from which two, three or more webs extend radially inwards, at the ends of which webs a latching member is arranged, wherein the latching elements together form the first latching member.

According to this refinement, the locking element is therefore not configured as a full-surface disc. Thus, the contact surface of the locking element is reduced. This is particularly advantageous if the locking element is arranged directly on the inner bottom surface of the lower part of the switch.

In this refinement, the annular section of the locking element is used for clamping and/or material-locking attachment to the lower part. The webs extending radially inwards from this section each serve as support for a latching element.

For example, a resilient tongue, a spring claw or a spring hook can be arranged at each of the radially inner ends of the webs, which resilient tongue, spring claw or spring hook protrudes upwards, transverse to the respective web. By providing two or three of such webs with resilient tongues, spring claws or spring hooks at their ends, a kind of bipod or tripod holder can be realized as a counterpart to the second latching member arranged on the movable contact member.

In an alternative refinement, it is provided that the locking element has a shape of a circular disc and comprises a central hole which is penetrated by the second latching member in the second switching position of the switching mechanism in such a way that the second latching member latches with the circular disc-shaped locking element.

The hole arranged centrally in the locking element thus forms a part of the first latching member. In this case, it is preferred that on the lower side of the movable contact member a plurality of resilient tongues, spring claws or spring hooks are arranged, which, when the switch is opened, penetrate the hole in the locking element and hook into the disc-shaped locking element at the edge of the hole to keep the switch in its open position.

The disc-shaped locking element having a central hole is preferably arranged clamped between a first and a second spacer element, wherein the first spacer element rests on the inner bottom surface of the lower part and a part of the switching mechanism rests, at least in the first shift position, with its edge on the second spacer element.

With the help of these two spacer elements, height and resistance can be easily adjusted, similar as already mentioned above. Accordingly, the two spacer elements are also according to this refinement preferably made of electrically insulating material.

The first spacer element arranged below the disc-shaped locking element serves as a support for the locking element. The second spacer element arranged above the disc-shaped locking element serves as a support for the switching mechanism at the edges. Together, the two spacer elements, which are preferably each configured as spacer rings, clamp the locking element between them and thus fix it in position.

In a further refinement, the locking element is made of metal and in particular in the form of sheet metal. The locking element is therefore a very cost-effective component, which hardly increases the production costs of the switch.

The temperature-dependent switching mechanism preferably comprises a temperature-dependent snap-action disc having a geometric high-temperature configuration and a geometric low-temperature configuration, as well as a spring disc on which the movable contact member is arranged.

The temperature-dependent snap-action disc is preferably configured as a bistable bimetal or trimetal snap-action disc.

Furthermore, it is preferred that the spring disc is configured as a bistable spring disc and has two temperature-independent stable geometric configurations, wherein, in its first configuration, the spring disc presses the movable contact member against the first contact and, in its second configuration, keeps the movable contact member spaced apart from the first contact.

This has the advantage that the spring disc in the closed state of the switch (in the first switching position of the switching mechanism) causes the closing force and thus the contact pressure between the movable contact member and the counter contact (first contact). This mechanically relieves the bimetal snap-action disc, which has a positive effect on its service life and the long-term stability of the response temperature.

If the spring disc is designed as a bistable spring disc having two temperature independent stable geometric configurations, this has the additional advantage that the spring disc keeps the switch, once having opened, in its open state. Even if the bimetal snap-action disc then snaps back into its low-temperature configuration after the switch has cooled down, the spring disc keeps the switch in its open position in addition to the mechanical closing lock.

It is also preferred that the snap-action disc, when transitioning from its low-temperature configuration into its high-temperature configuration, is supported by its edge at a part of the switch and thereby acts on the spring disc such that it snaps from its first into its second stable configuration, wherein it is also preferred that the snap-action disc and the spring disc are fixed to the movable contact member via their respective centers.

The advantage here is that the new switch can largely use standard temperature-dependent switching mechanisms, so that the design effort required to start series production of the new switch is low.

According to a further refinement, it is preferred that the movable contact member includes a movable contact part that interacts with the first contact, and that the spring disc interacts with the second contact, wherein it is further preferred that the spring disc, at least in its first configuration, is electrically connected to the second contact via its edge.

A similar configuration is disclosed in DE 10 2018 100 890 B3, DE 10 2007 042 188 B3 or DE 10 2013 101 392 A1. The result is that the snap-action disc is not current-loaded in any position of the switch, but that the load current of the electrical device to be protected flows through the spring disc.

In an alternative refinement, the movable contact member includes a current transfer member that interacts with both contacts.

The advantage here is that the switch can carry considerably higher currents than the switch disclosed in DE 10 2007 042 188 B3. The current transfer member arranged on the contact element ensures the electrical short circuit between the two contacts when the switch is closed, so that not only the snap-action disc but also the spring disc is no longer traversed by the load current, as this is disclosed in DE 10 2013 101 392 A1.

Furthermore, it is preferred that the first contact or each of the two contacts is arranged on an inner side of the upper part.

This measure ensures that when the upper part is mounted on the lower part, the geometrically correct alignment between the first contact or the first and second contact to the respective contact member or current transfer member is also established at the same time.

Further advantages result from the description and the attached drawings.

It goes without saying that the features referred to above and yet to be explained below can be used not only in the respective given combinations, but also in other combinations or alone without leaving the spirit and scope of the present disclosure.

DESCRIPTION OF PREFERRED EMBODIMENTS

Figure 1:
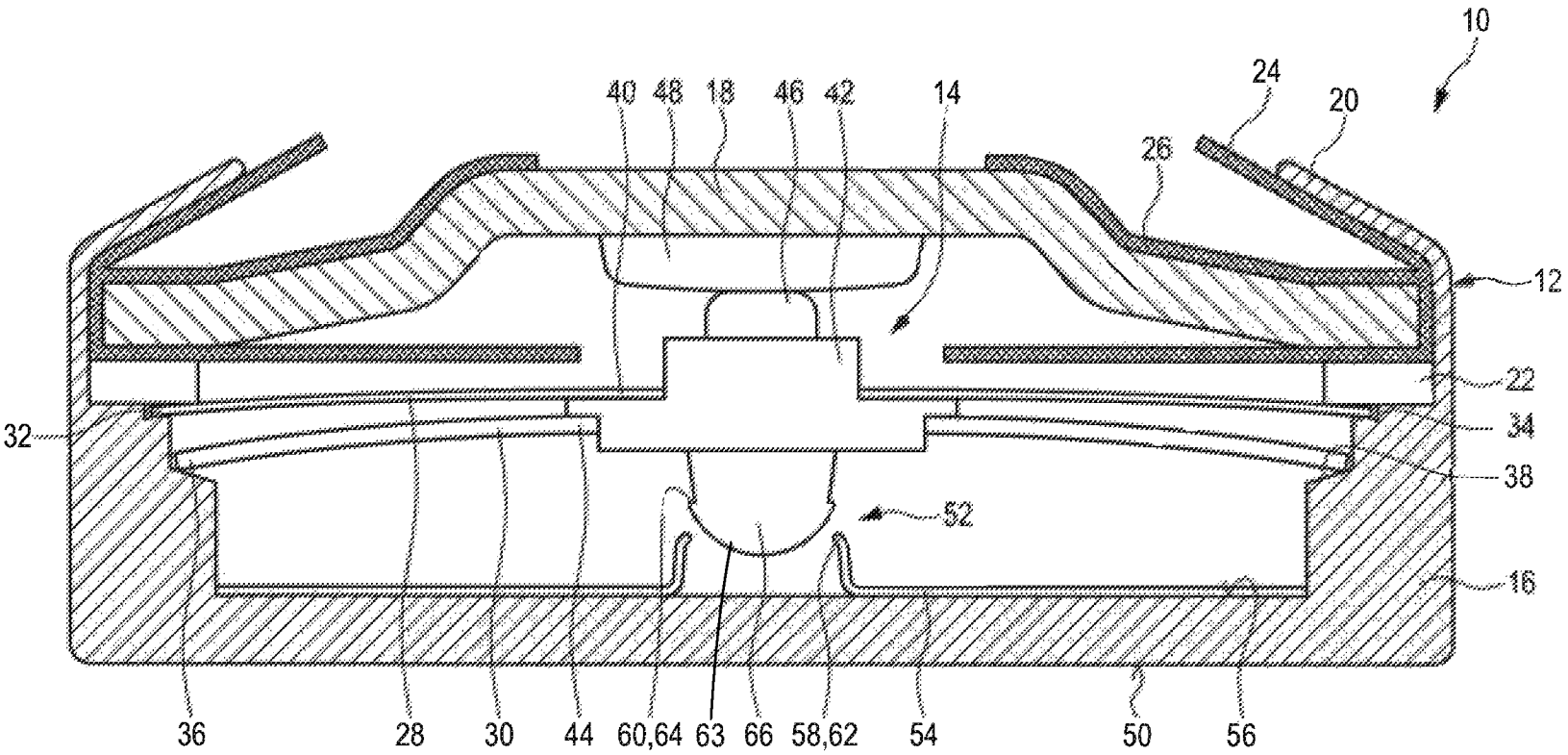
FIG. 1 shows a schematic sectional view of a first embodiment of the switch in its low-temperature position.

FIG. 1 shows a schematic sectional view of a switch 10, which is rotationally symmetrical in top view and preferably has a circular shape.

The switch 10 comprises a housing 12 in which a temperature-dependent switching mechanism 14 is arranged. The housing 12 comprises a pot-shaped lower part 16 and an upper part 18, which is held to the lower part 16 by a bent or flanged edge 20.

In the first embodiment shown in FIG. 1, both the lower part 16 and the upper part 18 are made of an electrically conductive material, preferably metal. A spacer ring 22, which supports the upper part 18 with an interposed insulating foil 24 and keeps the upper part 18 at a distance from the lower part 16, is arranged between the lower part 16 and the upper part 18.

The insulating foil 24 provides electrical insulation of the upper part 18 against the lower part 16. The insulating foil 24 also provides a mechanical seal that prevents liquids or impurities from entering the interior of the housing from outside.

Since the lower part 16 and the upper part 18 are in this embodiment each made of electrically conductive material, thermal contact to an electrical device to be protected can be produced via their outer surfaces. The outer surfaces are also used for the external electrical connection of the switch 10.

Another insulating foil 26 can be applied to the outside of the upper part 18, as shown in FIG. 1.

The switching mechanism 14 comprises a spring disc 28 and a temperature-dependent snap-action disc 30. The spring disc 28 is preferably designed as a bistable spring disc. Thus, it has two temperature-independent stable geometric configurations. The first configuration is shown in FIG. 1. The temperature-dependent snap-action disc 30 is preferably designed as a bistable snap-action disc as well. It has two temperature dependent configurations, a geometric high-temperature configuration and a geometric low-temperature configuration. In the first switching position of the switching mechanism 14 shown in FIG. 1, the snap-action disc 30 is in its geometric low-temperature configuration.

The spring disc 28 rests with its edge 32 on a circumferential shoulder 34 formed in the lower part 16 and is clamped between this shoulder 34 and the spacer ring 22. The snap-action disc 30 rests with its edge 36 on another shoulder 38, which is also formed circumferentially in the lower part 16.

The spring disc 28 is with its center 40 fixed to a movable contact member 42 of the switching mechanism 14. The snap-action disc 30 is with its center 44 also fixed to this contact member 42. In this way, the temperature-dependent switching mechanism 14 is a captive unit consisting of contact member 42, spring disc 28 and snap-action disc 30. When mounting the switch 10, the switching mechanism 14 can thus be inserted as a unit directly into the lower part 16.

On its upper side, the movable contact member 42 comprises a movable contact part 46. The movable contact part 46 interacts with a fixed counter contact 48, which is located on an inner side of the upper part 18. This counter contact 48 is herein also referred to as the first stationary contact. The outside of the lower part 16 serves as the second stationary contact 50.

In the position shown in FIG. 1, the switch 10 is in its low-temperature position, in which the spring disc 28 is in its first configuration and the snap-action disc 30 is in its low-temperature configuration. The spring disc 28 presses the movable contact part 42 against the first stationary contact 48.

In the closed low-temperature position of the switch 10 according to FIG. 1, an electrically conductive connection is thus produced between the first stationary contact 48 and the second stationary contact 50 via the movable contact member 42 and the spring disc 30.

Figure 2:
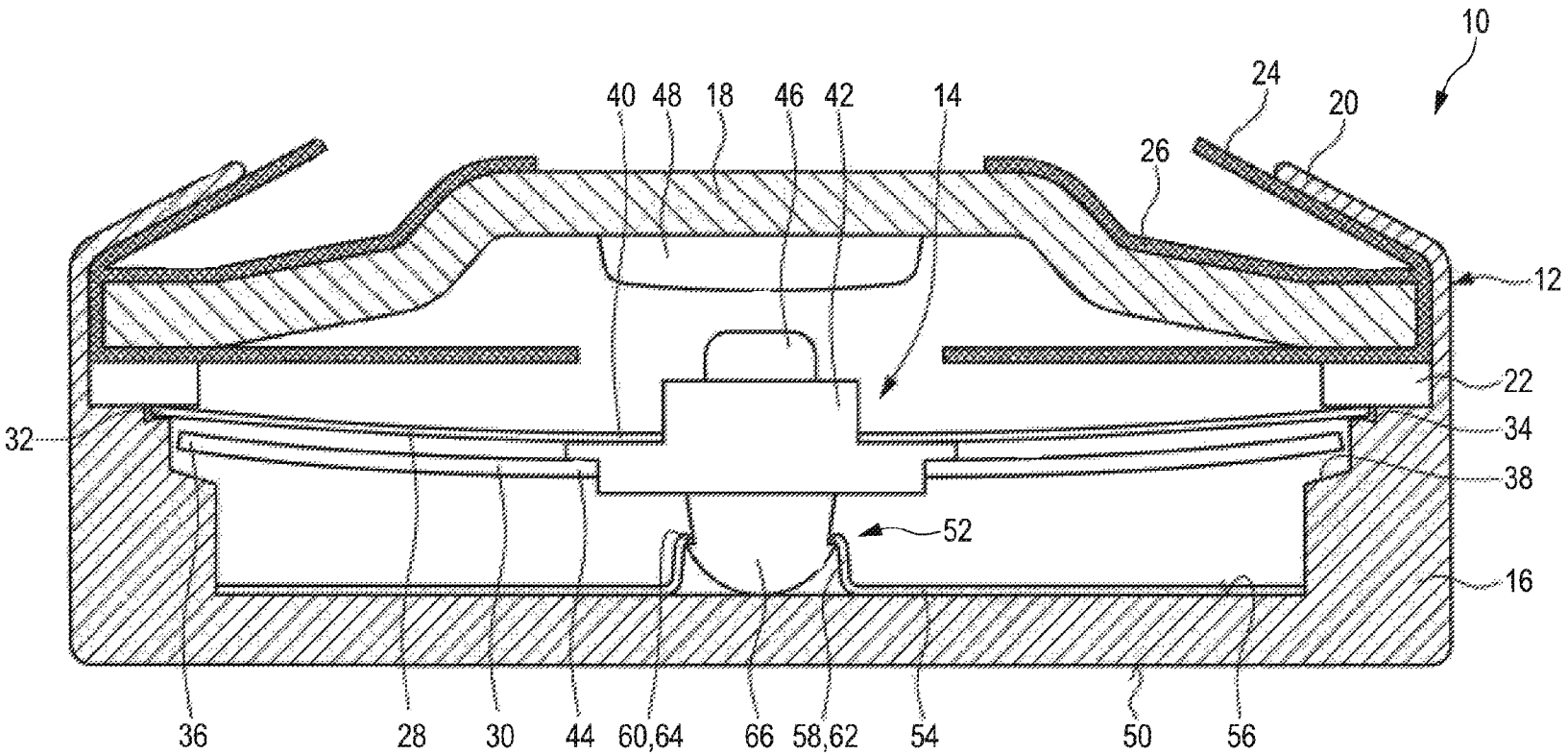
FIG. 2 shows a schematic sectional view of the first embodiment of the switch shown in FIG. 1 in its high-temperature position.

If the temperature of the device to be protected, and thus the temperature of the switch 10 and the snap-action disc 30 arranged therein, the snap-action disc snaps from the low-temperature configuration shown in FIG. 1 to its concave high-temperature configuration shown in FIG. 2. When this snap-action occurs, the edge 36 of the snap-action disc 30 is supported by a part of the switch 10, in this case by the edge 32 of the spring disc 28. Thereby, the snap-action disc 30 pulls with its center 44 the movable contact part 46 downwards and lifts off the movable contact part 46 from the first stationary contact 48. This simultaneously causes the spring disc 28 to bend downwards at its center 40 so that the spring disc 28 switches from its first stable geometric configuration shown in FIG. 1 to its second stable geometric configuration shown in FIG. 2. FIG. 2 thus shows the high-temperature position of the switch 10 in which it is open. The electric circuit is thus disconnected.

When the device to be protected and thus the switch 10 including the snap-action disc 30 then cool down again, the snap-action disc 30 snaps back into its low-temperature position, as shown for example in FIG. 1. In this case, the snap-action disc 30 would actually move the spring disc 28 back to its first configuration shown in FIG. 1 and thus close the switch 10 again. However, with the switch 10, this resetting process is prevented by a closing lock 52.

The closing lock 52 comprises a substantially plate- or disc-shaped locking element 54, which in the first embodiment shown in FIGS. 1 and 2 is materially bonded to the inner bottom surface 56 of the lower part 16. The locking element 54 comprise a first latching member 58 which, in the high-temperature position of the switch 10 shown in FIG. 2, interacts with a second latching member 60 arranged at the movable contact member 42 to mechanically lock the switching mechanism 14.

In the first embodiment of the switch 10, which is shown in FIGS. 1 and 2, the first latching member 58 comprises a plurality of spring claws 62. The second latching member 60, on the other hand, is configured as a latching lug 64, which is formed circumferentially on a type of anchor 66, which is attached to the lower side of the movable contact member 42. The anchor 66 is either attached to the contact member 42 or formed integrally with it. The anchor 66 thus forms a component of the movable contact member 42.

When assembling the switch 10, the locking element 54 together with the first latching member 58 can be inserted as a separate component into the lower part 16 and then welded or soldered to the inner bottom surface 56. This fixes the locking element 54 to the lower part.

As can be seen in particular from FIG. 2, the anchor 66 with its latching lug 64 latches with the spring claws 62 arranged on the locking element 54 as soon as the snap-action disc 30 snaps into its high-temperature configuration due to temperature conditions and the switch 10 is opened. A re-closing of the switch 10 is then permanently prevented because the spring claws 62 of the locking element 54 keep the anchor 66 permanently in the lower position shown in FIG. 2, regardless of whether the snap-action disc 30 snaps back into its geometric low-temperature configuration or not.

In order to enable a latching between the two latching members 58, 60 that is as simple as possible, the spring claws 62 are preferably elastically resilient. As soon as the anchor 66 moves into the space between the spring claws 62 when switch 10 is opened, the spring claws are spread radially outwards and then snap back radially inwards into the latching lug 64 provided on the anchor 66 as soon as the movable contact member 42 together with the anchor 66 has moved sufficiently far down (see FIG. 2).

The locking of the spring claws 62 with the latching lug 64 can be further facilitated if the lower end 63 of the movable contact member 42 or of the anchor 66 is round, tapered or frustoconical, since, upon opening of the switch 10, the anchor 66 can then be moved past the spring claws 62 without much resistance until they latch with the latching lug 64.

Except for the first latching member 58 or the spring claws 62, the locking element 54 can have a shape of a plate or disc. In the first embodiment shown in FIGS. 1 and 2, however, it is advantageous if the locking element 54 is only substantially plate- or disc-shaped having a plurality of recesses, as shown schematically in FIG. 6.

Figure 6:
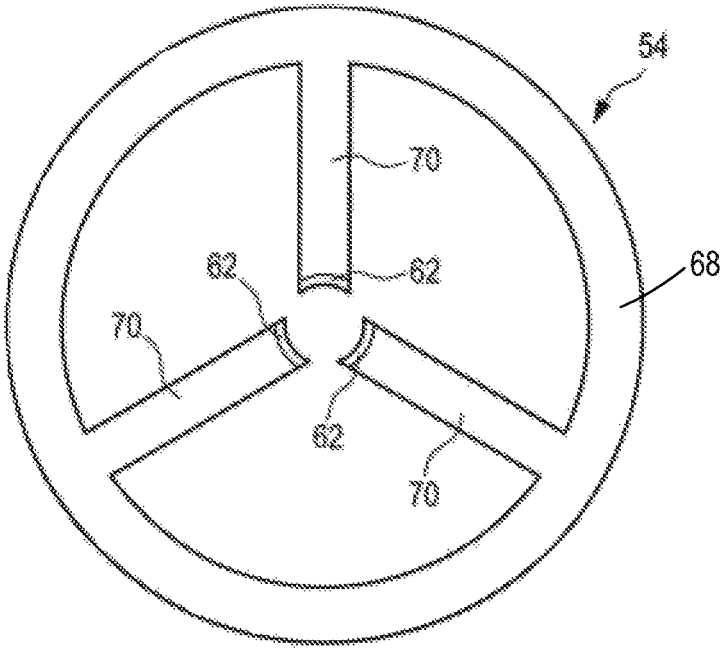
FIG. 6 shows a top view from above of a locking element according to a first embodiment which is used in the switch.

In the embodiment shown in FIG. 6, the locking element 54 comprises an annular section 68, from which three webs 70 extend radially inward. A spring claw 62 is arranged at each end of the webs 70 as a latching element. The three spring claws 62 act as a kind of tripod that interacts in the open state of the switch 10 with the latching lug 64 formed on the anchor 66. This results in a mechanically determined latching connection.

Figure 3:
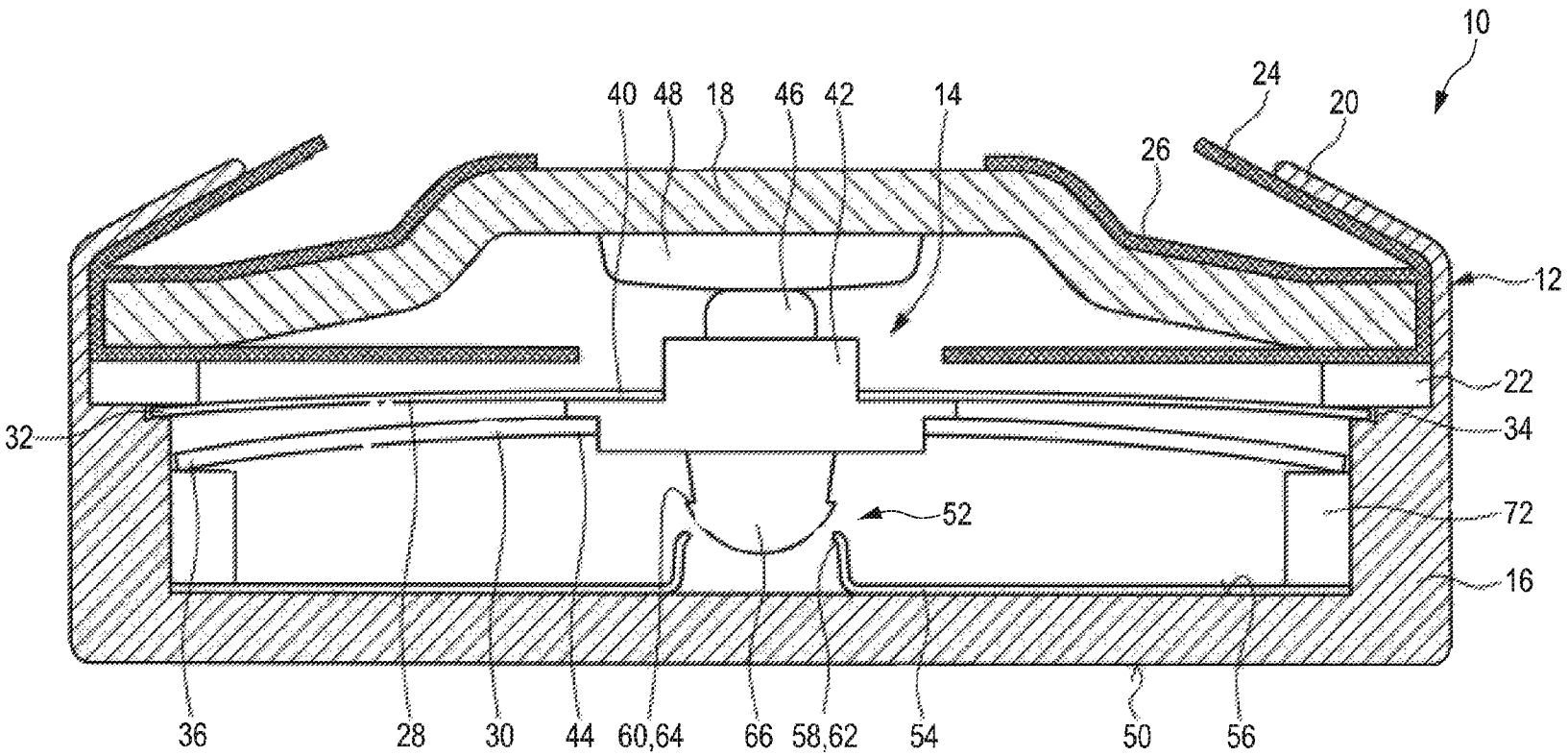
FIG. 3 shows a schematic sectional view of a second embodiment of the switch in its low-temperature position.

FIG. 3 shows a second embodiment of the switch 10, in which the housing 12 and the switching mechanism 14 are basically of the same construction as in the first embodiment shown in FIGS. 1 and 2. The closing lock 52 is also basically the same as in the first embodiment. However, according to the second embodiment, the locking element 54 is not firmly bonded to the inner bottom surface 56, but is instead arranged clamped in the lower part 16.

A spacer element 72 is used to clamp the locking element 54. This spacer element 72 is preferably configured as a spacer ring. The spacer ring 72 can be fixed in the lower part 16, for example by means of an interference fit.

The substantially disc-shaped locking element 54 is thus clamped between the spacer element 72 and the inner bottom surface 56 of the lower part 16. Since a firmly bonded connection of the locking element 54 with the lower part 16 is not required here, this embodiment of the switch 10 can be manufactured even more easily than embodiment of the switch 10 shown in FIGS. 1 and 2.

The spacer element 72 also offers the advantage that the position of the switching mechanism 14 can be adjusted depending on the height of the spacer element 72. In this example, the snap-action disc 30 rests with its edge 36 on the spacer element 72.

The spacer element 72 is preferably made of electrically insulating material. At least the ohmic resistance of the spacer element 72 can be adjusted in such a way that it prevents current from flowing through the snap-action disc 30 resting on the spacer element 72, when the switch is closed. This prolongs the service life of the snap-action disc 30.

The use of the spacer element 72 offers the further advantage that the shoulder 38, which would otherwise have to be provided, can be omitted (see FIGS. 1 and 2). The lower part 16 can therefore be produced much more easily. It can, for example, be produced as a punched part.

Figure 4:
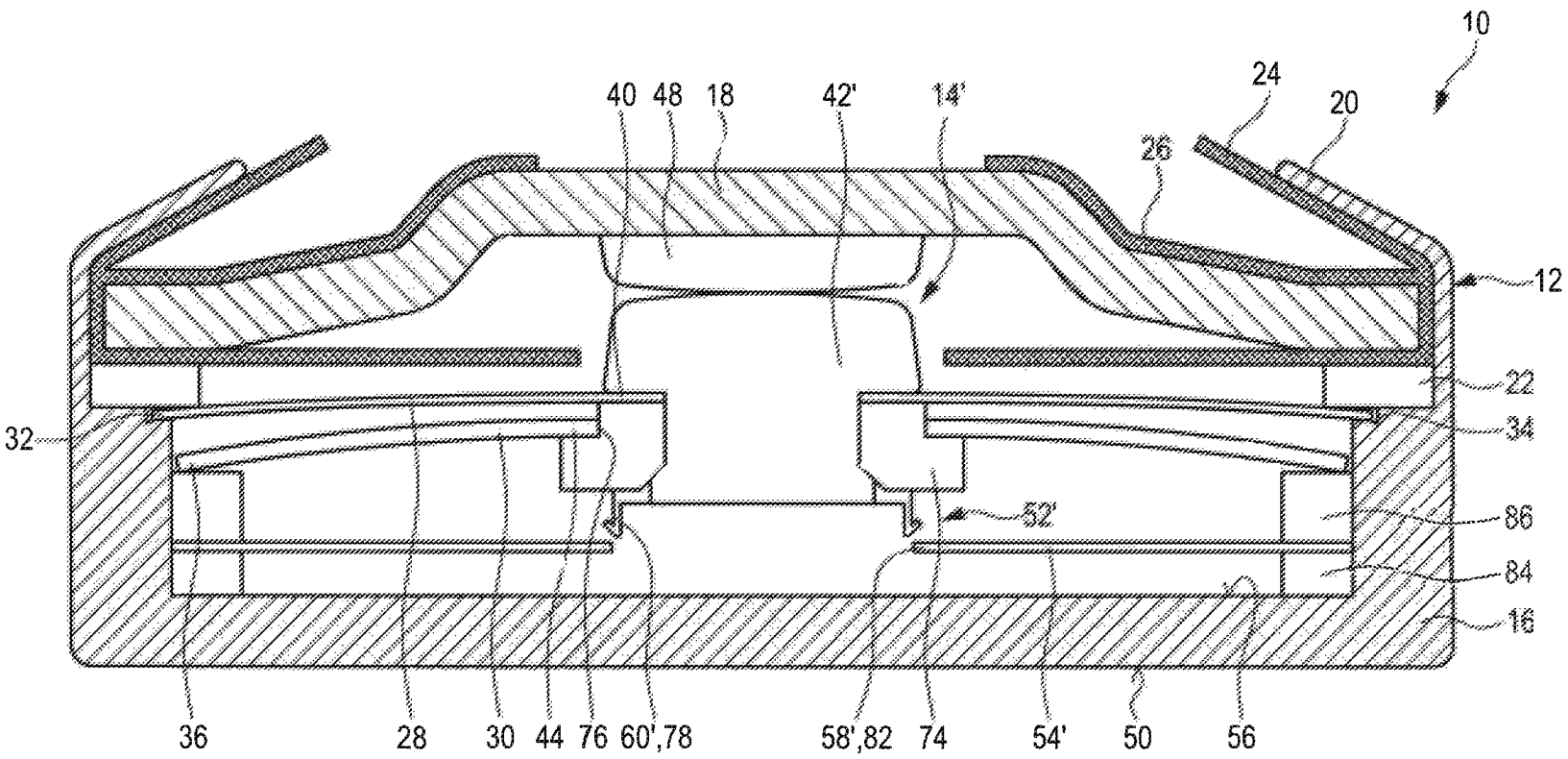
FIG. 4 shows a schematic sectional view of a third embodiment of the switch in its low-temperature position.

FIG. 4 schematically shows a third embodiment of the switch 10. Therein, the housing 12 of the switch 10 is basically the same or at least similar to the first two embodiments shown in FIGS. 1-3. However, the layout of the switching mechanism 14' and the layout of the closing lock 52' differentiate the switch 10 according to the third embodiment from the first two examples.

The movable contact member 42' additionally comprises a ring 74 surrounding the contact member 42'. This ring 74 is preferably pressed onto the contact member 42'.

The ring 74 comprises a circumferential shoulder 76 on which the snap-action disc 30 rests with its center 44. The spring disc 28 is clamped between the ring 74 and the upper widened section of the contact member 42'. In this way, the temperature-dependent switching mechanism 14' shown in FIG. 4 is a captive unit consisting of contact element 42', spring disc 28 and snap-action disc 30 just like the switching mechanism 14 shown in FIGS. 1-3.

In the region of the lower end of the contact element 42', the second latching member 60' is arranged. This can be designed in one piece with the contact element 42', directly attached to the contact element 42' or attached to the ring 74.

The second latching member 60' here preferably comprises one or more resilient tongues 78. These resilient tongues 78 interact with the first latching member 58' of the locking element 54' in the sense of the closing lock 52' when the switch is open.

Figure 7:
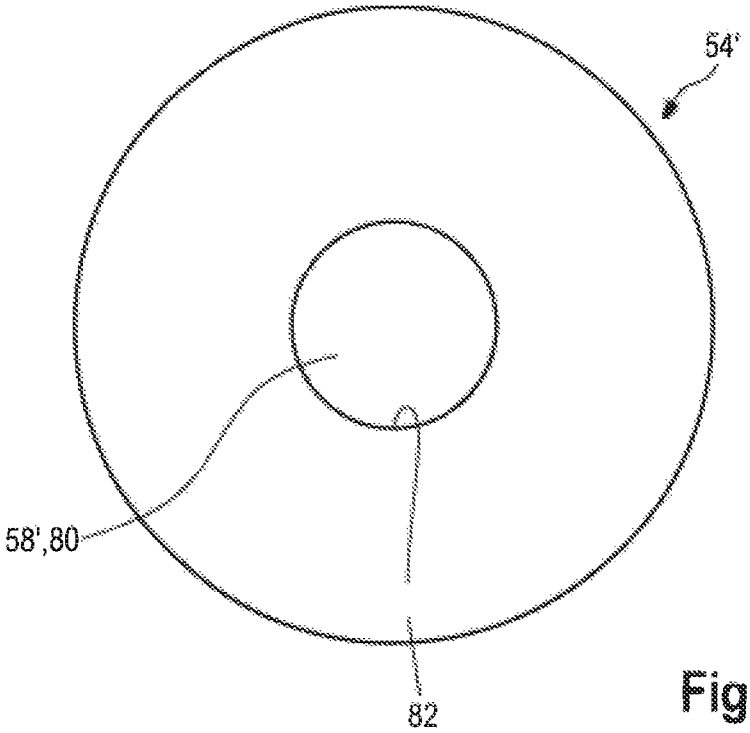
FIG. 7 shows a top view from above of the locking element according to a second embodiment which is used in the switch.

In this case, the locking element 54' is configured as a circular disc with a central hole 80. The locking element 54' is exemplarily shown in FIG. 7 in a top view from above.

In this embodiment, the hole 80 or the inner edge 82 of the locking element 54' surrounding the hole 80 acts as a second latching member 60 that interacts with the resilient tongues 78 to realize the closing lock 52'.

In the embodiment shown in FIG. 4, the disc-shaped locking element 54' is arranged, as before, between the switching mechanism 14' and the inner bottom surface 56 of the lower part 16. However, it does not rest directly on the inner bottom surface 56. Instead, the locking element 54' in FIG. 4 is clamped between two spacer elements 84, 86.

The first spacer element 84 rests on the inner bottom surface 56 of the lower part 16 and is arranged below the locking element 54'. The second spacer element 86 is arranged above the locking element 54'. A part of the switching mechanism 14', in this case the outer edge 36 of the snap-action disc 30, rests on the second spacer element 86. Both spacer elements 84, 86 are preferably configured as spacer rings.

Otherwise, the closing lock 52' works in the above-mentioned way and locks the switching mechanism 14' after the switch 10 has been opened by means of the snap-action disc 30 due to temperature conditions.

Figure 5:
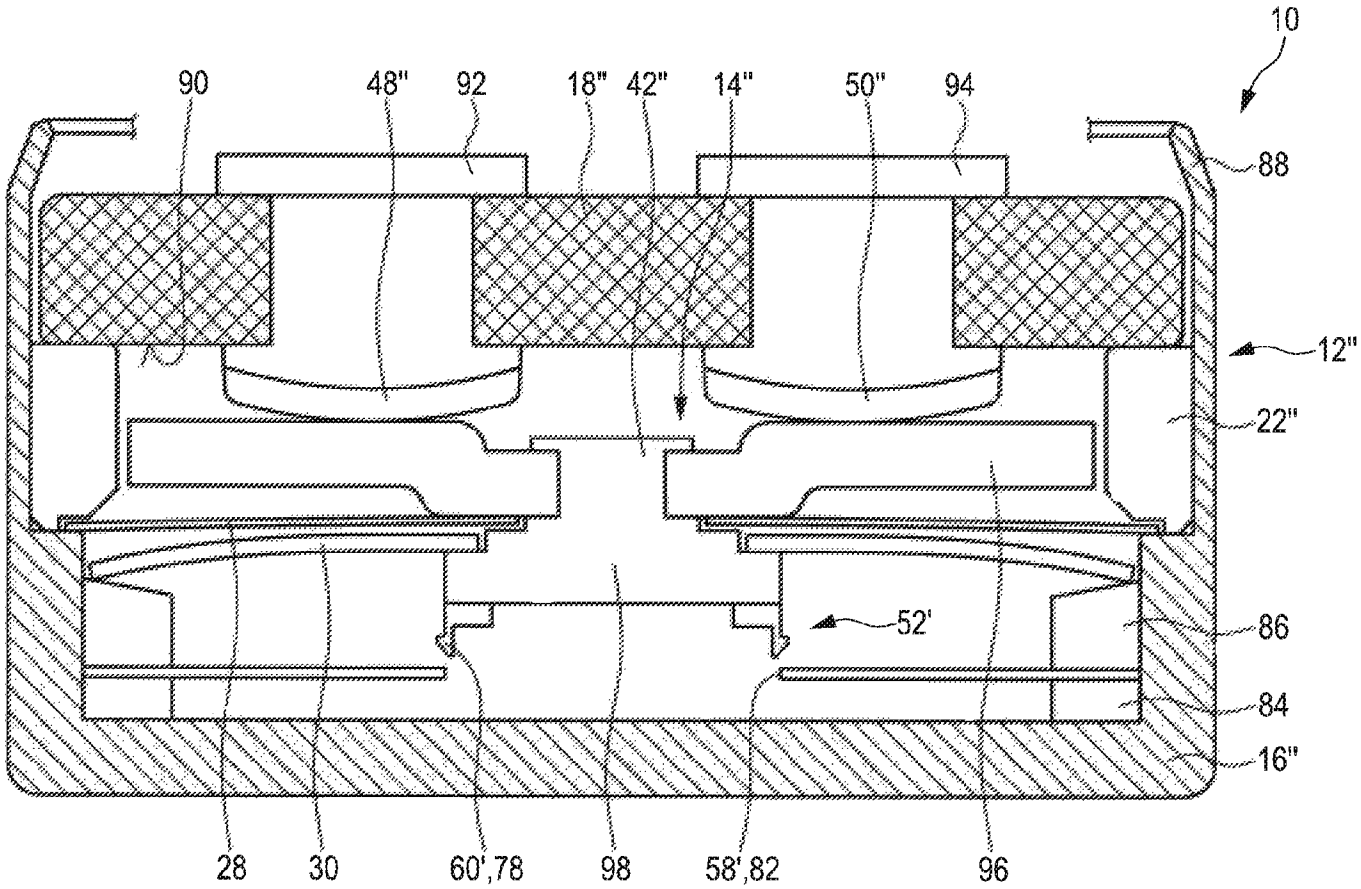
FIG. 5 shows a schematic sectional view of a fourth embodiment of the switch in its low-temperature position.

In the fourth embodiment of the switch 10 shown in FIG. 5, the closing lock 52' is designed in the same or a similar way above the third embodiment of switch 10 shown in FIG. 4. According to the fourth embodiment, the switch 10 differs fundamentally in the layout of the housing 12" and the switching mechanism 14".

The lower part 16" is again made of an electrically conductive material. The flat upper part 18" is instead made of an electrically insulating material. It is held to the lower part 16" by a bent edge 88.

Between the upper part 18" and the lower part 16", a spacer ring 22" is provided here as well, which keeps the upper part 18" at a distance from the lower part 16". On its inner side, the upper part 18" comprises a first stationary contact 48" and a second stationary contact 50". The contacts 48" and 50" are designed as rivets which extend through the upper part 18" and end outside in the heads 92, 94, which serve for the external connection of the switch 10.

The movable contact member 42" in this case includes a current transfer member 96, which is in the embodiment shown in FIG. 5 a contact plate, the upper side of which is coated with an electrically conductive coating so that it provides an electrically conductive connection between the two contacts 48" and 50" in the contact position shown in FIG. 5 The current transfer member 96 is connected to the spring disc 28 and the snap-action disc 30 via a rivet 98, which is also to be regarded as part of the contact member 42".

An advantage of the switch design shown in FIG. 5 is that, in contrast to the first three embodiments of the switch shown in FIGS. 1-4, no current flows through either the spring disc 28 or the snap-action disc 30 when the switch is closed. This current flows only from the first external connection 92 via the first stationary contact 48", the current transfer member 96 and the second stationary contact 50" to the second external connection 94.

It goes without saying that not only the embodiment of the closing lock 52' shown in FIG. 4 can be used with the switch assembly shown in FIG. 5, but also the embodiments of the closing lock 52 shown in FIGS. 1-3.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch, comprising:

a housing having a lower part and an upper part;

a first stationary contact that is arranged on the upper part of the housing;

a second stationary contact that is arranged on the housing;

a temperature-dependent switching mechanism that is arranged in the housing and comprises a movable contact member, wherein, in a first switching position, the switching mechanism presses the movable contact member against the first stationary contact and thereby produces an electrically conductive connection between the first stationary contact and the second stationary contact via the movable contact member, and wherein, in a second switching position, the switching mechanism keeps the movable contact member spaced apart from the first stationary contact and thereby disconnects the electrically conductive connection; and a closing lock that prevents the switch once having opened from closing again by locking the switching mechanism permanently in the second switching position in a mechanical manner, wherein the closing lock comprises a substantially disc- or plate-shaped locking element, which is arranged locally between the switching mechanism and an inner bottom surface of the lower part, the locking element being clamped in the lower part and/or connected to the lower part by means of a firmly bonded connection, and wherein the closing lock comprises a first latching member and a second latching member, the first latching member being arranged on the locking element and the second latching member being arranged on the movable contact member, wherein the first latching member and the second latching member interact with each other in the second switching position in order to lock the switching mechanism.

2. The switch according to claim 1, wherein one of the first latching member and the second latching member comprises a resilient tongue, a spring claw or a spring hook, and wherein the respective other one of the first latching member and the second latching member comprises a recess, a hole or a latching lug.

3. The switch according to claim 1, wherein the locking element is clamped between a first spacer element and a second spacer element, the first spacer element and the second spacer element being inserted into the housing.

4. The switch according to claim 3, wherein the first spacer element rests on the inner bottom surface of the lower part, and wherein the switching mechanism rests, at least in the first switching position, on the second spacer element.

5. The switch according to claim 4, wherein the first spacer element comprises as a first spacer ring, and wherein the second spacer element comprises a second spacer ring.

6. The switch according to claim 1, wherein the firmly bonded connection between the closing lock and the lower part of the housing is a welded or soldered connection.

7. The switch according to claim 1, wherein the movable contact member comprises an anchor having a latching lug that forms the second latching member, the anchor and the latching lug being arranged on a lower side of the movable contact member facing the inner bottom surface.

8. The switch according to claim 7, wherein the anchor has a frustoconical, round or tapered shape between the latching lug and a lower end of the anchor facing the inner bottom surface.

9. The switch according to claim 1, wherein the locking element has a shape of a circular disc and comprises a central hole, wherein, in the second switching position, the second latching member penetrates through the central hole and latches with the first latching member.

10. The switch according to claim 1, wherein the switching mechanism comprises a temperature-dependent bimetal snap-action disc having a geometric high-temperature configuration and a geometric low-temperature configuration, and wherein the switching mechanism comprises a spring disc on which the movable contact member is arranged.

11. The switch according to claim 10, wherein the spring disc is a bistable spring disc having two temperature-independent stable geometric configurations, wherein, in a first of the two geometric configurations, the spring disc presses the movable contact member against the first stationary contact and, in a second of the two geometric configurations, the spring disc keeps the movable contact member spaced apart from the first stationary contact.

12. The switch according to claim 11, wherein the bimetal snap-action disc, when transitioning from its low-temperature configuration into its high-temperature configuration, is supported by its edge at a part of the switch and acts on the spring disc such that the spring disc snaps from the first geometric configuration into the second geometric configuration.

13. The switch according to claim 11, wherein the spring disc is in the first geometric configuration electrically connected to the second contact via its edge.

14. The switch according to claim 10, wherein the bimetal snap-action disc and the spring disc are each fixed to the movable contact member.

15. The switch according to claim 10, wherein the first stationary contact is arranged on an inner side of the upper part of the housing, wherein the movable contact member comprises a movable contact part that interacts with the first stationary contact, and wherein the spring disc interacts with the second stationary contact.

16. The switch according to claim 1, wherein the first stationary contact and the second stationary contact are arranged on an inner side of the upper part of the housing, and wherein the movable contact member comprises a current transfer member that interacts with the first stationary contact and the second stationary contact.

17. A temperature-dependent switch, comprising:

a housing having a lower part and an upper part;

a first stationary contact that is arranged on the upper part of the housing;

a second stationary contact that is arranged on the housing;

a temperature-dependent switching mechanism that is arranged in the housing and comprises a movable contact member, wherein, in a first switching position, the switching mechanism presses the movable contact member against the first stationary contact and thereby produces an electrically conductive connection between the first stationary contact and the second stationary contact via the movable contact member, and wherein, in a second switching position, the switching mechanism keeps the movable contact member spaced apart from the first stationary contact and thereby disconnects the electrically conductive connection; and a closing lock that prevents the switch once having opened from closing again by locking the switching mechanism permanently in the second switching position in a mechanical manner, wherein the closing lock comprises a substantially disc- or plate-shaped locking element, which is arranged locally between the switching mechanism and an inner bottom surface of the lower part, the locking element being clamped in the lower part and/or connected to the lower part by means of a firmly bonded connection, and wherein the closing lock comprises a first latching member and a second latching member, the first latching member being arranged on the locking element and the second latching member being arranged on the movable contact member, wherein the first latching member and the second latching member interact with each other in the second switching position in order to lock the switching mechanism, wherein the locking element is clamped between a spacer element and the lower part of the housing.

18. The switch according to claim 17, wherein the switching mechanism rests, at least in the first switching position, on the spacer element.

19. The switch according to claim 18, wherein the spacer element comprises a spacer ring.

20. A temperature-dependent switch, comprising:

a housing having a lower part and an upper part;

a first stationary contact that is arranged on the upper part of the housing;

a second stationary contact that is arranged on the housing;

a temperature-dependent switching mechanism that is arranged in the housing and comprises a movable contact member, wherein, in a first switching position, the switching mechanism presses the movable contact member against the first stationary contact and thereby produces an electrically conductive connection between the first stationary contact and the second stationary contact via the movable contact member, and wherein, in a second switching position, the switching mechanism keeps the movable contact member spaced apart from the first stationary contact and thereby disconnects the electrically conductive connection; and a closing lock that prevents the switch once having opened from closing again by locking the switching mechanism permanently in the second switching position in a mechanical manner, wherein the closing lock comprises a substantially disc- or plate-shaped locking element, which is arranged locally between the switching mechanism and an inner bottom surface of the lower part, the locking element being clamped in the lower part and/or connected to the lower part by means of a firmly bonded connection, and wherein the closing lock comprises a first latching member and a second latching member, the first latching member being arranged on the locking element and the second latching member being arranged on the movable contact member, wherein the first latching member and the second latching member interact with each other in the second switching position in order to lock the switching mechanism, wherein the locking element comprises an annular section and at least two webs extending radially inwards from the annular section, wherein each of the at least two webs comprises a free end at which a latching element is arranged, wherein the latching elements together form the first latching member.

* * * * *